US008601745B2

(12) United States Patent
Berkley

(10) Patent No.: US 8,601,745 B2
(45) Date of Patent: Dec. 10, 2013

(54) OPERATOR FOR MOVABLE SASH

(75) Inventor: Scot Berkley, Owatonna, MN (US)

(73) Assignee: Truth Hardware, Owatonna, MN (US)

( * ) Notice: Subject to any disclaimer, the term of this patent is extended or adjusted under 35 U.S.C. 154(b) by 244 days.

(21) Appl. No.: 12/817,681

(22) Filed: Jun. 17, 2010

(65) Prior Publication Data

US 2010/0325964 A1 Dec. 30, 2010

Related U.S. Application Data

(60) Provisional application No. 61/187,920, filed on Jun. 17, 2009.

(51) Int. Cl.
*E05F 11/00* (2006.01)

(52) U.S. Cl.
USPC ..... 49/325; 49/339

(58) Field of Classification Search
USPC ..... 49/325, 339, 340, 341; 52/200
See application file for complete search history.

(56) References Cited

U.S. PATENT DOCUMENTS

| | | | | | |
|---|---|---|---|---|---|
| 3,638,358 | A | * | 2/1972 | Mason | 49/325 |
| 4,189,248 | A | * | 2/1980 | Sully | 403/11 |
| 4,497,135 | A | | 2/1985 | Vetter | |
| 4,505,601 | A | * | 3/1985 | Sandberg et al. | 384/428 |
| 4,521,993 | A | * | 6/1985 | Tacheny et al. | 49/325 |
| 4,750,118 | A | | 6/1988 | Heitschel et al. | |
| 4,933,613 | A | | 6/1990 | Berner et al. | |
| 4,945,678 | A | | 8/1990 | Berner et al. | |
| 4,972,629 | A | | 11/1990 | Merendino et al. | |
| 5,004,961 | A | | 4/1991 | Berner et al. | |
| 5,040,331 | A | | 8/1991 | Merendino et al. | |
| 5,226,256 | A | | 7/1993 | Fries et al. | |
| 5,285,137 | A | | 2/1994 | Midas et al. | |
| 5,313,737 | A | | 5/1994 | Midas | |
| 5,355,059 | A | | 10/1994 | McMillian | |
| 5,379,453 | A | | 1/1995 | Tigwell | |
| 5,449,987 | A | | 9/1995 | McMillian | |
| 5,467,266 | A | | 11/1995 | Jacobs et al. | |
| 5,493,813 | A | | 2/1996 | Vetter et al. | |
| 5,555,683 | A | | 9/1996 | Schroeder | |
| 5,605,013 | A | | 2/1997 | Hogston | |
| 5,813,171 | A | | 9/1998 | Piltingsrud | |
| 5,829,199 | A | * | 11/1998 | Harvey et al. | 49/325 |
| 5,839,229 | A | * | 11/1998 | Briggs et al. | 49/246 |
| 5,848,634 | A | | 12/1998 | Will et al. | |
| 5,878,530 | A | | 3/1999 | Eccleston et al. | |
| 5,977,732 | A | | 11/1999 | Matsumoto | |
| 6,051,945 | A | | 4/2000 | Furukawa | |
| 6,128,858 | A | * | 10/2000 | Vetter et al. | 49/342 |
| 6,374,544 | B1 | * | 4/2002 | Ellis | 49/249 |
| 6,528,782 | B1 | | 3/2003 | Zhang et al. | |
| 6,652,777 | B2 | | 11/2003 | Rapp et al. | |

(Continued)

*Primary Examiner* — Jerry Redman
(74) *Attorney, Agent, or Firm* — Patterson Thuente Pedersen PA

(57) ABSTRACT

A window operator mountable on the frame of window having a hinged movable sash including a drive assembly for positioning the movable sash and a separately installable drive shaft for operating the drive assembly. The drive assembly includes a drive chain coupled to the movable sash of the window that extends and retracts to position the movable sash. The drive assembly can be mounted to the frame first without the drive shaft. After the window is installed, the drive shaft can be then inserted into the drive assembly and used to extend and retract the drive chain and move the movable sash. The window operator includes a drive shaft retention assembly for receiving and retaining the drive shaft once the drive shaft is inserted into the drive assembly.

6 Claims, 18 Drawing Sheets

(56) References Cited

U.S. PATENT DOCUMENTS

| | | | | |
|---|---|---|---|---|
| 6,667,590 | B2 | 12/2003 | Nagaoka | |
| 6,672,010 | B1 * | 1/2004 | Gledhill et al. | 49/341 |
| 6,983,783 | B2 | 1/2006 | Carmen et al. | |
| 7,886,493 | B2 * | 2/2011 | Jorgensen et al. | 52/403.1 |
| 8,087,322 | B1 * | 1/2012 | Morris | 74/606 R |
| 8,141,295 | B2 * | 3/2012 | Carrier | 49/249 |
| 2003/0098791 | A1 | 5/2003 | Carlson et al. | |
| 2003/0144104 | A1 | 7/2003 | Ryberg | |
| 2005/0263254 | A1 | 12/2005 | Sievers et al. | |
| 2007/0271848 | A1 | 11/2007 | Wolf et al. | |
| 2010/0071266 | A1 * | 3/2010 | Archambault | 49/327 |

* cited by examiner

OPERATOR FOR MOVABLE SASH

CLAIM TO PRIORITY

This application claims the benefit of U.S. Provisional Application No. 61/187,920 entitled "Operator for Movable Sash," filed Jun. 17, 2009, the entire contents of which are incorporated herein by reference.

FIELD OF THE INVENTION

The present invention relates to operators for shiftable fenestration components and more specifically to operators for windows having hinged movable sashes.

BACKGROUND OF THE INVENTION

Skylights, casement windows and other types of windows having hinged movable sashes are a popular option for allowing natural light to enter into an enclosed space. Commonly found in both residential and commercial settings, skylights and windows generally include a pane of transparent or translucent material that enables the entry of sunlight while providing a physical barrier between the enclosed space and the outside environment.

Despite their popularity, skylights can have drawbacks. Among these drawbacks is a tendency to promote condensation and unnecessarily heat the enclosed space in warm climates or during warm seasons. To minimize or reduce these drawbacks, skylights have been developed which can be selectively opened and closed. An opened skylight allows warm air that has accumulated in the skylight well to escape into the outer environment. An opened skylight can also facilitate the circulation of natural air within the enclosed space.

Window and skylight operators having a worm with an integrally formed worm shaft to which a handle is permanently or releasably secured are known in the art. Such integrally formed worm shafts and associated handles can be seen in U.S. Pat. Nos. 5,272,837; 4,189,248; and 4,209,266, for example. With the worm secured to the window operator, the worm shaft and associated handle conventionally extend some distance from the window operator.

It is also known in the art to secure the above-described window operators to a window to form a window assembly which is shipped to the customer who then installs the window assembly in his or her home. Because of the additional clearance required to accommodate the worm shaft (and sometimes the handle) extending from the window operator, these window assemblies are expensive to package and to ship. Additionally, the handle and worm shaft can end up damaging other windows during installation if the windows are not kept spaced from each other a proper distance, in addition to damaging the operators themselves.

It is known in the art to conceal the worm shaft by disposing it in a passage in a wall and to remotely drive the worm by a handle via a temporary coupling. French Patent No. 2,467,954 discloses a window operator having a worm with an integrally formed worm shaft which is disposed at one end of a narrow passage which extends through a wall. A coupling is provided which extends from the worm shaft to the other end of the passage, where a handle may be used to rotate the worm via this coupling. This window operator system, however, does not address the problems disclosed above caused by the worm shaft extending from the window assembly prior to installation, such as the expensive shipping and packaging costs involved with such assemblies, or the damage to other windows caused during installation using such windows assemblies. In addition, the window operator system disclosed requires elaborate preparatory work to be performed on the wall prior to the installation of the window operator. The window operator system also discloses that the window operator be secured to the external surface of the building, where it is exposed to environmental factors, such as precipitation and extreme temperatures.

U.S. Pat. No. 5,493,813 also discloses a temporary coupling for a handle used in conjunction with a motor-driven window operator which has an alternative manual drive to be used to open and close the window. In one embodiment of the manual drive, a worm is coupled to a handle in an operative position. However, the handle is intended to be only temporarily coupled, even in the operative position, so as to not disturb the aesthetic appearance of the window. Consequently, the forces generated in opening and closing the window using the alternative manual drive can cause the male shaft to become separated from the female worm. Further, neither French Patent No. 2,467,954 nor U.S. Pat. No. 5,493,813 address the problems associated with conventional operators, including the stresses encountered with an angularly oriented worm (which orientation is required for proper operation so that the person does not hurt himself or the window when turning the handle by banging his hand against the window) and the necessity that the handle as connected to the operator be essentially wobble free to provide a reliable and quality feel when being turned.

Although the devices and methods disclosed in U.S. Pat. No. 6,128,858, hereby fully incorporated herein by reference, were directed toward overcoming one or more of the problems discussed above, there remains a need for secure drive shaft engagement in such assemblies, while still enabling field serviceability of the operator.

SUMMARY OF THE INVENTION

The present invention is directed to a skylight operator that addresses the aforementioned needs of the industry. The present invention generally comprising an operator mounted on the frame of the window having a drive assembly and an insertable drive shaft. The drive assembly further comprises an extendable and retractable drive chain coupled to a hinged movable sash of the window. The extension and retraction of the drive chain opens and closes the window by changing the position of the sash relative to the frame of the window. The drive assembly also comprises a sprocket engaging the drive chain such that the rotation of the sprocket causes the drive chain extend or retract. The present invention is particularly suited for windows having fenestration assemblies such as casement windows and skylights.

The drive shaft can be inserted into the drive assembly after the drive assembly has been mounted to the frame of the skylight. The drive shaft is inserted into the drive assembly such that the drive shaft engages the sprocket, wherein rotation of the drive shaft causes the sprocket to rotate, which in turn extends or retracts the drive chain. According to an embodiment of the present invention, a drive shaft retainer assembly is operably linked to the drive assembly for receiving and locking the drive shaft within the drive assembly once the drive shaft is inserted into the drive assembly. The drive shaft retainer can further comprise a locking ring having a plurality of tabs for engaging the exterior of the drive shaft and preventing the drive shaft from being removed from the drive assembly. According to an embodiment of the invention, the plurality of tabs may be angled inward such that the drive shaft can be inserted into the locking ring without the tabs engaging the exterior of the drive shaft, but attempting to withdraw the drive shaft causes the tabs to engage the drive shaft preventing removal. The drive shaft retainer can also comprise at least one removable fastener for fastening the drive shaft to the drive assembly.

The above summary of the various representative embodiments of the invention is not intended to describe each illustrated embodiment or every implementation of the invention. Rather, the embodiments are chosen and described so that others skilled in the art can appreciate and understand the principles and practices of the invention. The figures in the detailed description that follow more particularly exemplify these embodiments.

BRIEF DESCRIPTION OF THE DRAWINGS

The invention may be more completely understood in consideration of the following detailed description of various embodiments of the invention in connection with the following drawings, in which.

Figure 1:
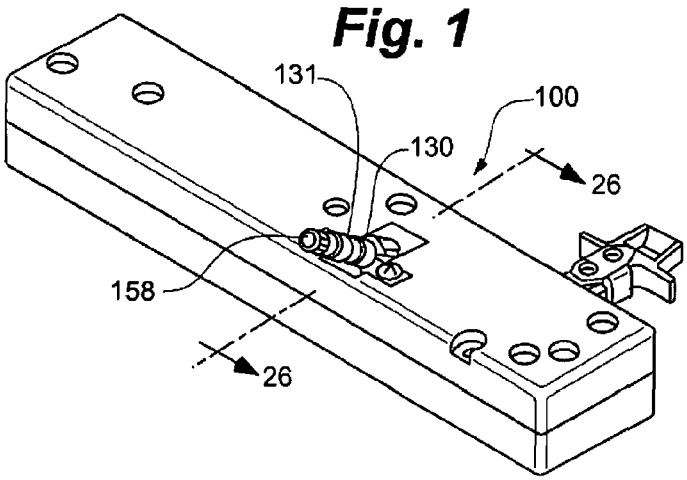
FIG. 1 is a perspective view of a skylight operator according to an embodiment of the invention.
Figure 2:
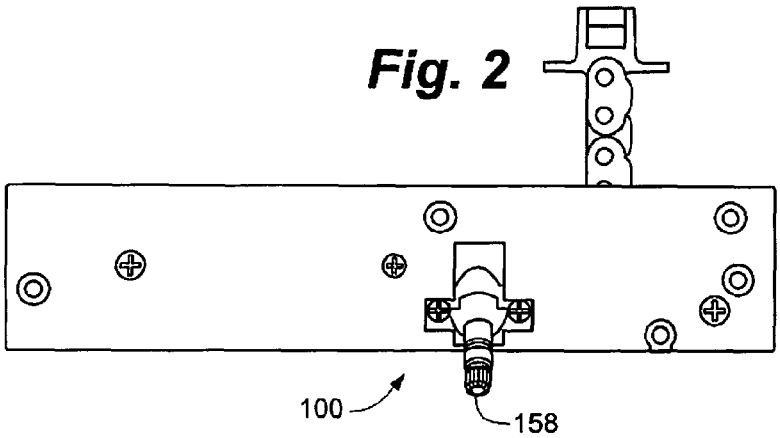
FIG. 2 is a top plan view of the skylight operator of FIG. 1.
Figure 3:
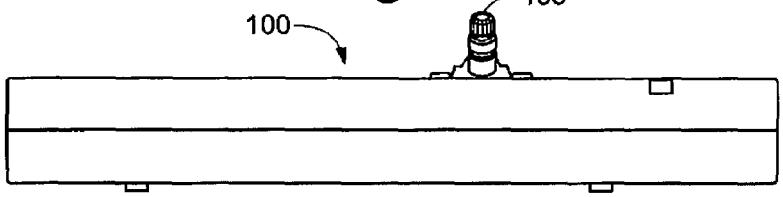
FIG. 3 is a front elevation view of the skylight operator of FIG. 1.
Figure 4:
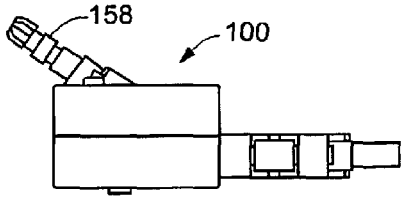
FIG. 4 is a side elevation view of the skylight operator of FIG. 1.
Figure 1A:
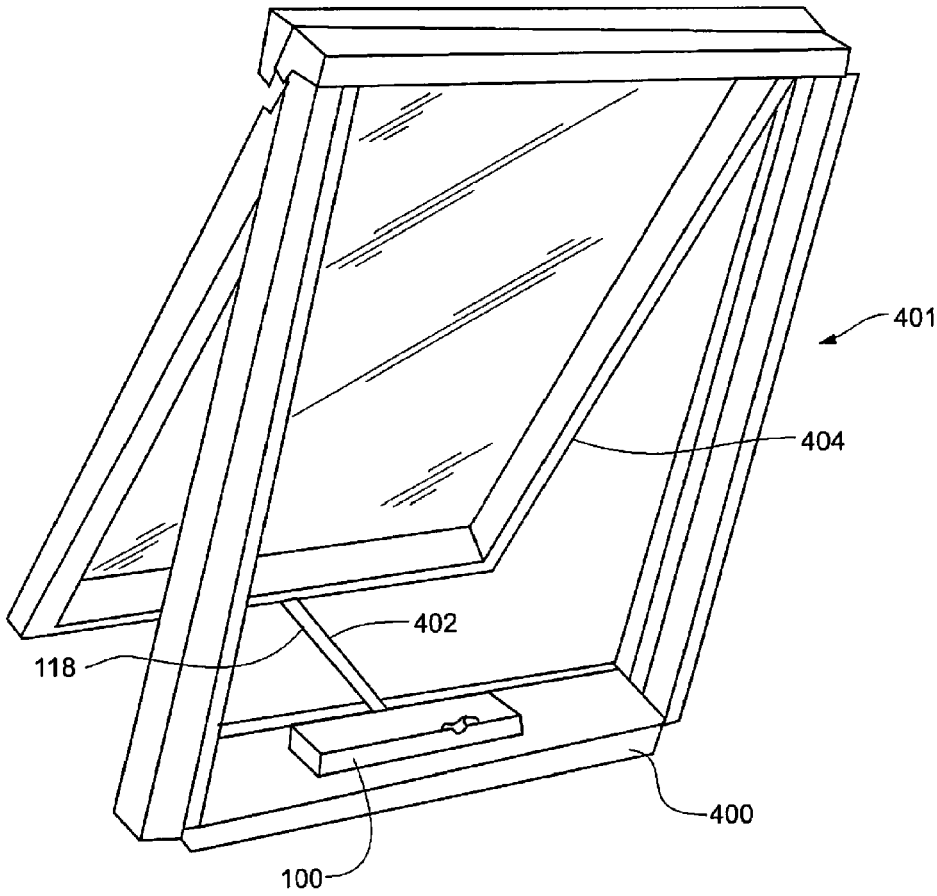
FIG. 1A is a perspective view of a skylight assembly according to an embodiment of the invention.
Figure 6:
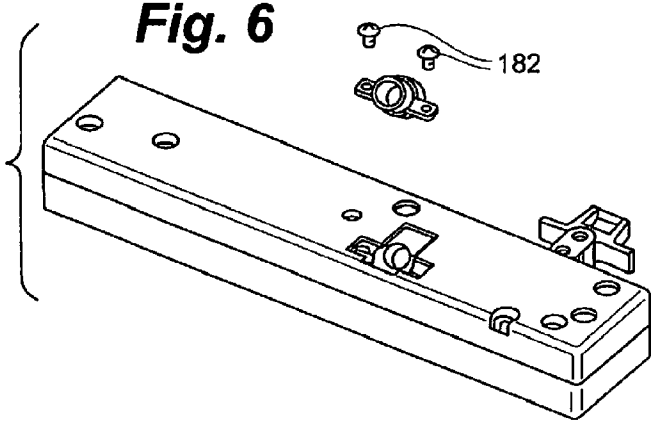
FIG. 6 is another exploded fragmentary view of the operator of FIG. 1.
Figure 7:
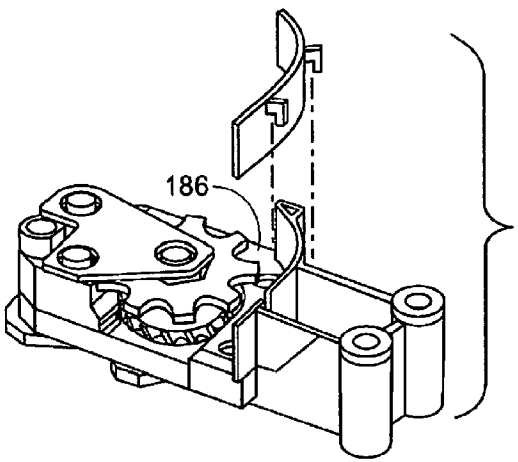
FIG. 7 is a bottom perspective view of the drive assembly of the operator of FIG. 1.
Figure 5:
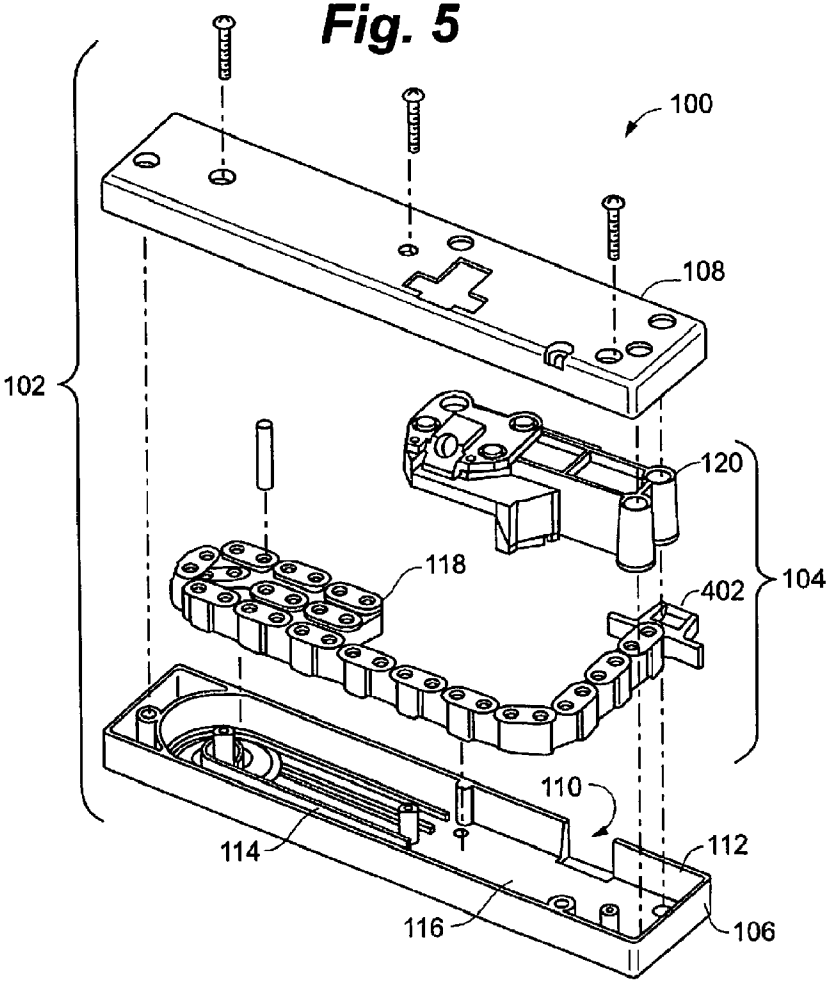
FIG. 5 is an exploded fragmentary view of the operator of FIG. 1.

While the present invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION OF THE DRAWINGS

Referring now to FIGS. 1-15, there is depicted an operator 100 for an operable skylight or window according to a first embodiment of the invention. Operator 100 generally includes housing assembly 102, and drive assembly 104. Housing assembly 102 generally includes lower housing 106 and upper housing 108. Lower housing 106 defines chain aperture 110 in wall 112 and chain track 114 on the inside surface of bottom wall 116.

Figure 9:
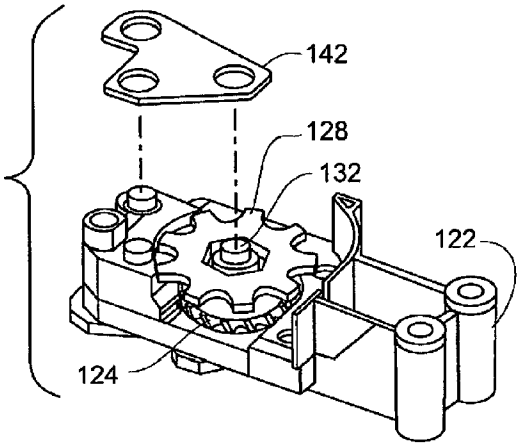
FIG. 9 is a partial exploded view of the drive assembly of the operator of FIG. 1.
Figure 10:
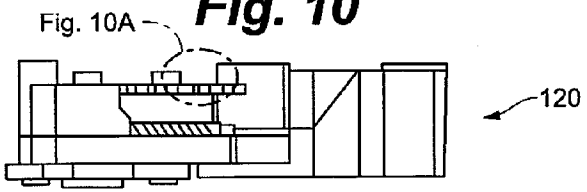
FIG. 10 is a side elevation view of the drive assembly of the operator of FIG. 1.
Figure 10A:
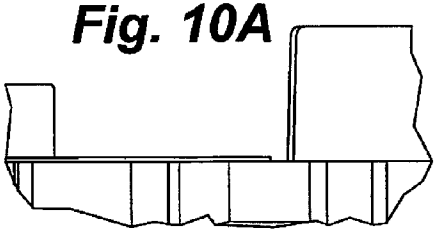
Figure 8:
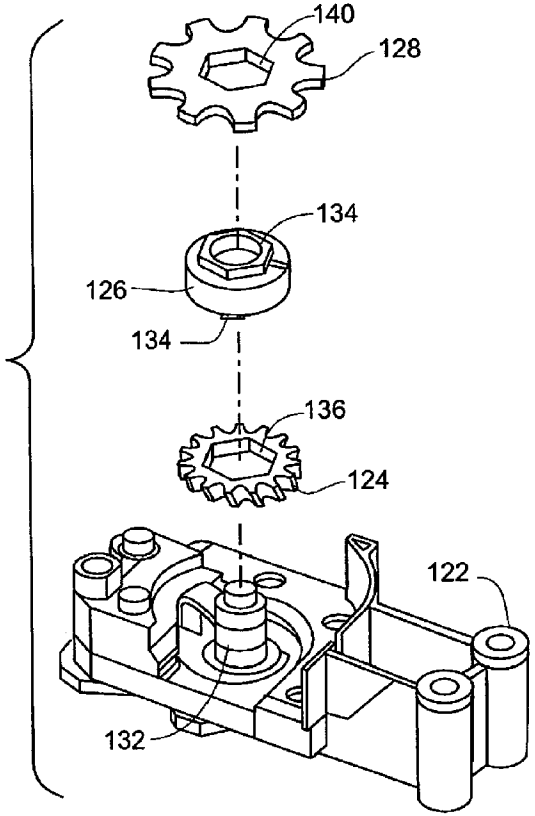
FIG. 8 is a partial exploded view of the drive assembly of the operator of FIG. 1.

Drive assembly 104 generally includes drive chain 118 and drive 120. Drive 120 generally includes body 122, pinion 124, bushing 126, sprocket 128, worm assembly 130, and drive shaft assembly 131. Exploded view FIG. 8 depicts drive assembly 104 inverted so as to enable viewing of the underside of the assembly. Bushing 126 is rotatably received on shaft 132, and has hex engagement portions 134 on both sides thereof. Pinion 124 is disposed between bushing 126 and body 122 with one of hex portions 134 engaged in hex aperture 136 so as to rotatably fix pinion 124 with bushing 126. Sprocket 128 is disposed on outer side 138 of bushing 126 with the other of hex portions 134 engaged in hex aperture 140 to rotatably lock sprocket 128 to bushing 126. Pinion 124, bushing 126, and sprocket 128 are retained in place on shaft 132 with retainer plate 142 as depicted in FIG. 9.

Figure 11:
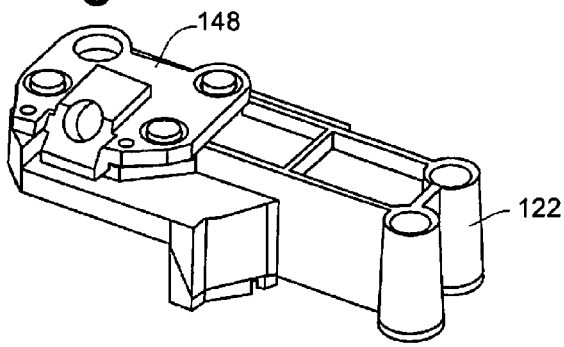
FIG. 11 is a top perspective view of the worm assembly of the operator of FIG. 1.
Figure 12:
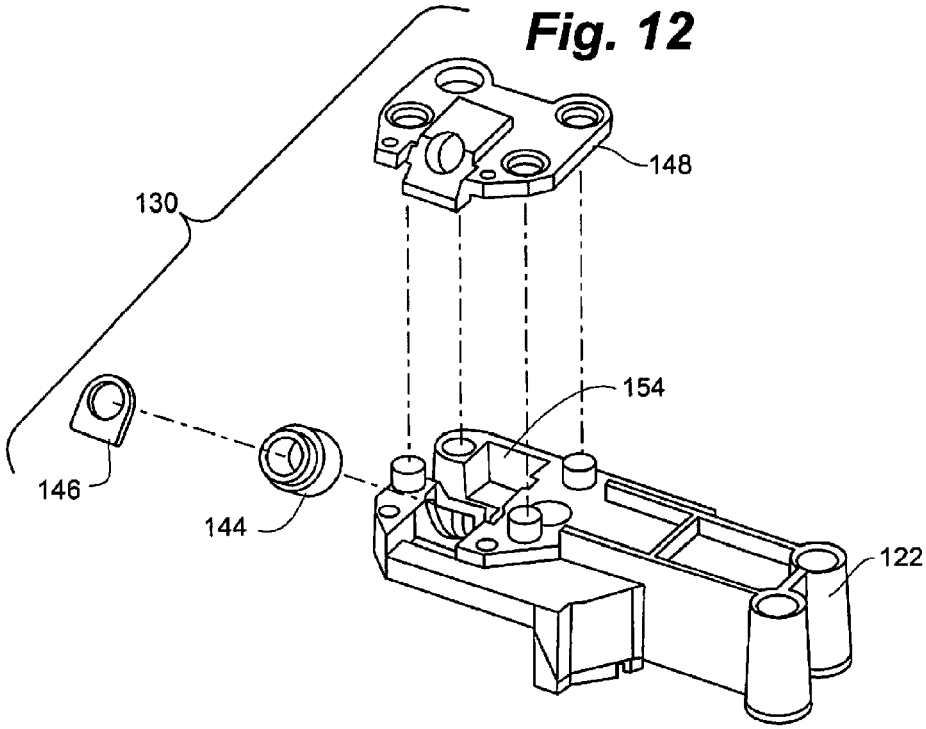
FIG. 12 is an exploded view of the drive assembly and worm assembly of the operator of FIG. 1.

Worm assembly 130, depicted in FIGS. 11 and 12 generally includes worm 144, retainer 146, and cover 148. As depicted in the views of FIG. 16, worm 144 defines recess 150 with internal splines 152. Worm 144 is rotatably received in recess 154 on the upper side of body 122, with recess 150 facing outward as depicted in FIG. 12. Thread 155 of worm 144 engages pinion 124 through aperture 156 in body 122 such that pinion 124 along with sprocket 128 are rotatable with worm 144. Worm 144 is retained in position with retainer 146 and cover 148. Further details of retainer 146 and cover 148 in a particular embodiment of the invention are depicted and disclosed in FIGS. 17 and 18 respectively.

Figure 13:
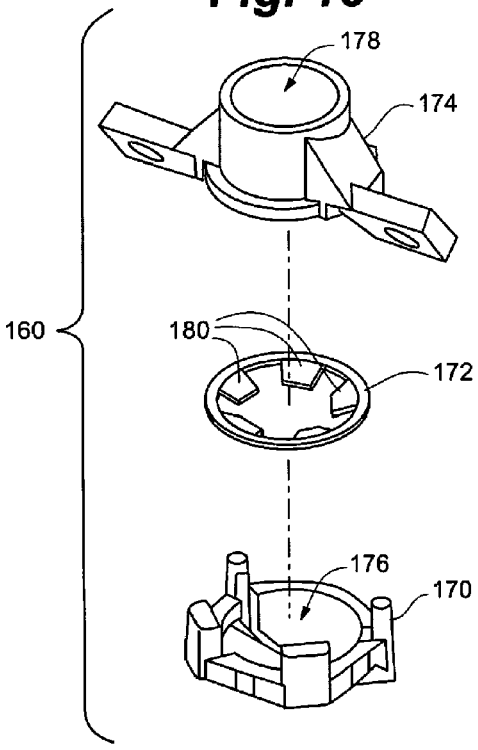
FIG. 13 is an exploded view of the drive shaft retainer assembly of the operator of FIG. 1.
Figure 14:
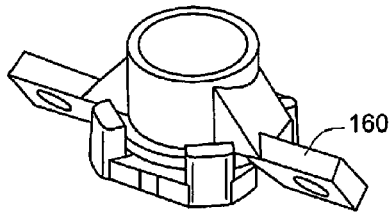
FIG. 14 is a top perspective view of the drive shaft retainer assembly of the operator of FIG. 1.
Figure 15:
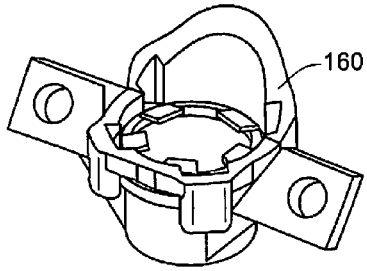
FIG. 15 is a bottom perspective view of the drive shaft retainer assembly of the operator of FIG. 1.
Figure 16A:
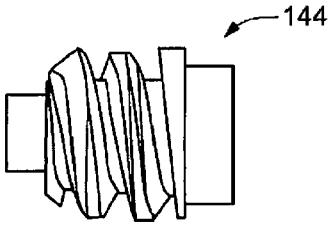
FIGS. 16A-16E are views of the worm portion of the drive shaft assembly of the operator of FIG. 1.
Figure 16B:
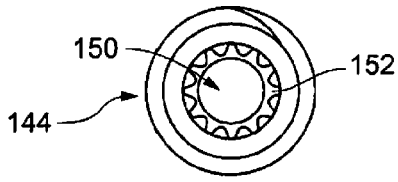
Figure 16C:
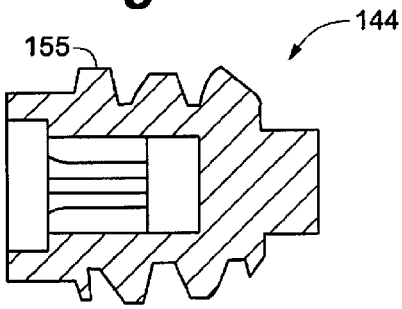
Figure 16D:
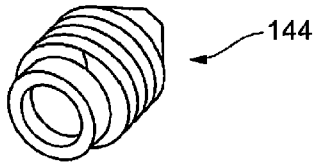
Figure 16E:
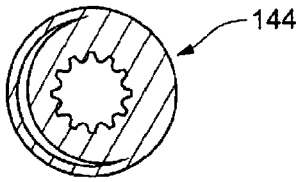
Figure 17A:
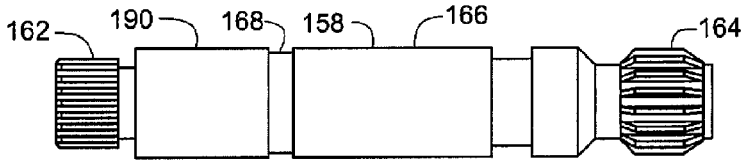
FIGS. 17A-17D are views of the drive shaft portion of the drive shaft assembly of the operator of FIG. 1.
Figure 17B:
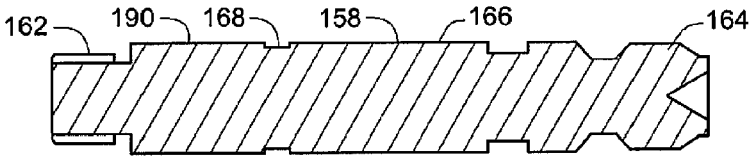
Figure 17C:
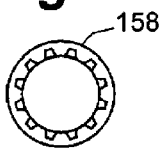
Figure 17D:
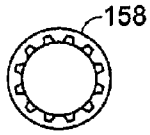
Figure 18A:
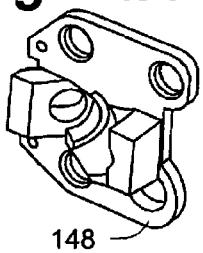
FIGS. 18A-18I are views of the drive shaft cover portion of the drive shaft assembly of the operator of FIG. 1.
Figure 18B:
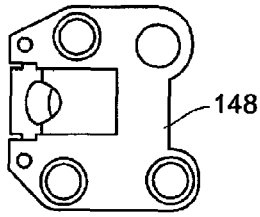
Figure 18C:
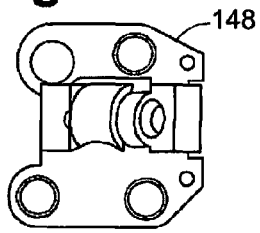
Figure 18D:
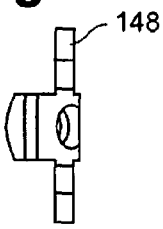
Figure 18E:
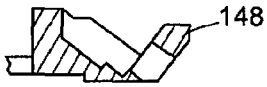
Figure 18F:
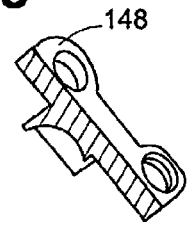
Figure 18G:
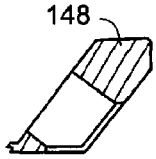
Figure 18H:
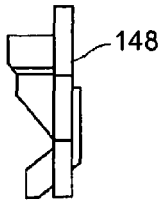
Figure 18I:
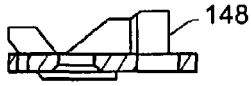
Figure 19A:
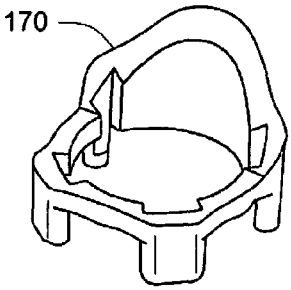
FIGS. 19A-19E are views of the drive shaft assembly lower housing of the operator of FIG. 1.
Figure 19B:
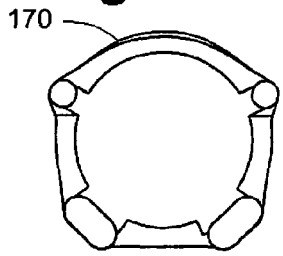
Figure 19C:
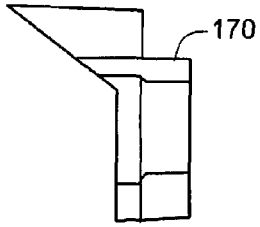
Figure 19D:
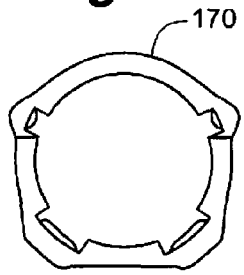
Figure 19E:
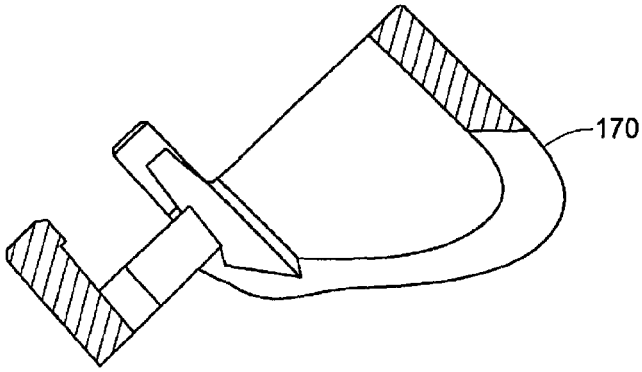
Figure 20A:
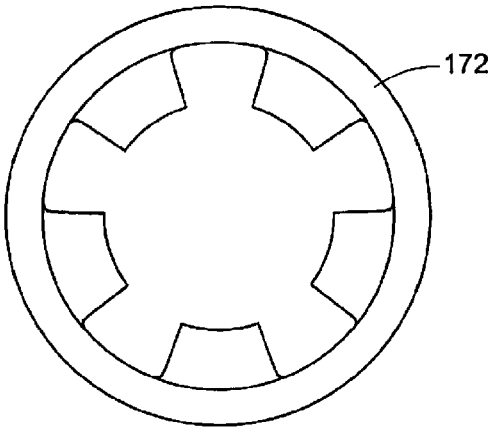
FIGS. 20A-20B are views of the lock washer of the drive shaft retainer assembly of the operator of FIG. 1.
Figure 20B:
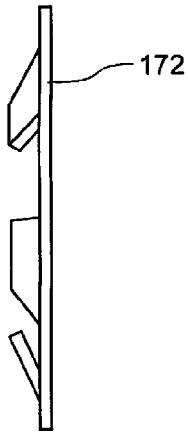
Figure 21:
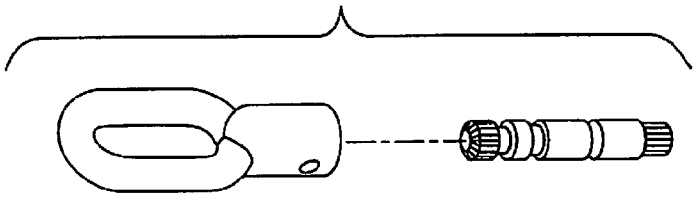
FIG. 21 is a perspective view of the drive shaft and interface assembly of the operator of FIG. 1.
Figure 22A:
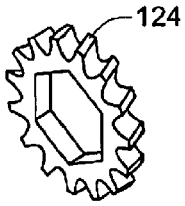
FIGS. 22A-22C are views of the pinion of the operator of FIG. 1.
Figure 22B:
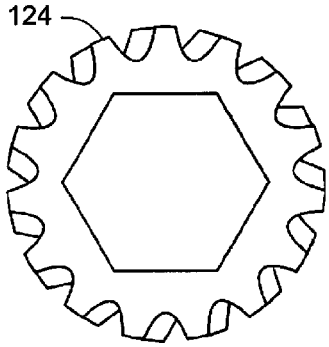
Figure 22C:
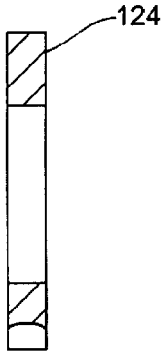
Figure 23A:
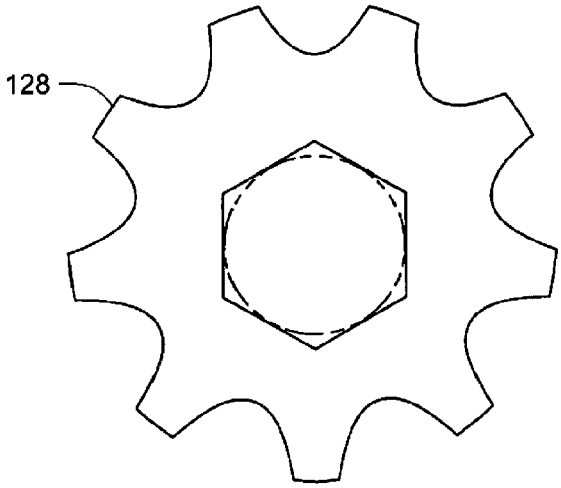
FIGS. 23A-23B are views of the sprocket of the operator of FIG. 1.
Figure 23B:
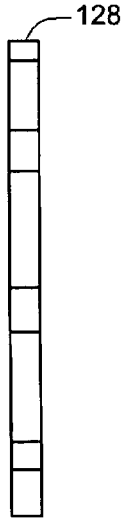
Figure 24A:
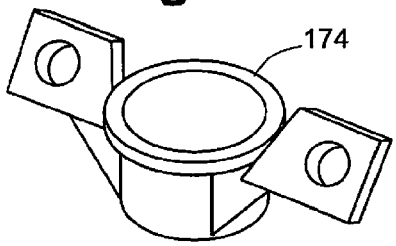
FIGS. 24A-24D are views of the drive shaft assembly upper housing of the operator of FIG. 1.
Figure 24B:
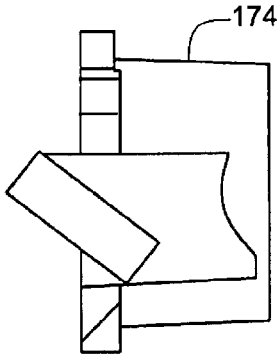
Figure 24C:
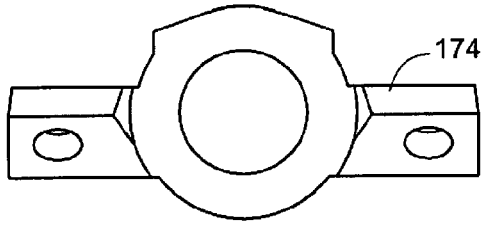
Figure 24D:
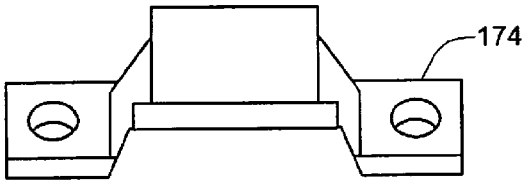
Figure 25A:
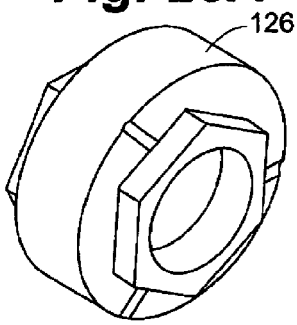
FIGS. 25A-25E are views of the bushing of the operator of FIG. 1.
Figure 25B:
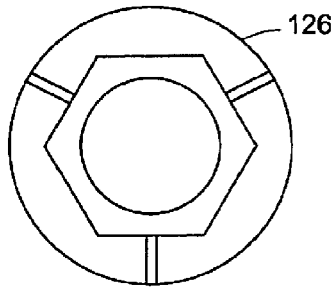
Figure 25C:
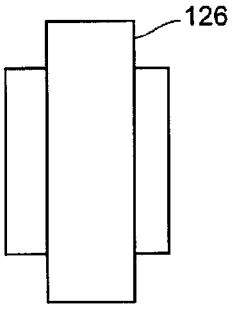
Figure 25D:
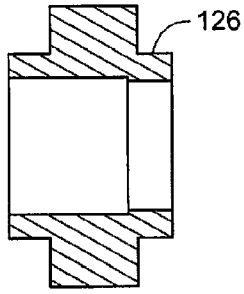
Figure 25E:
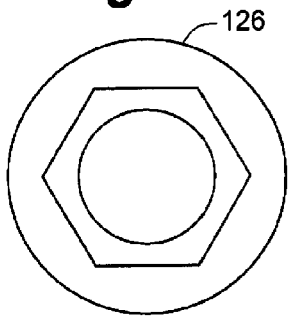
Figure 26:
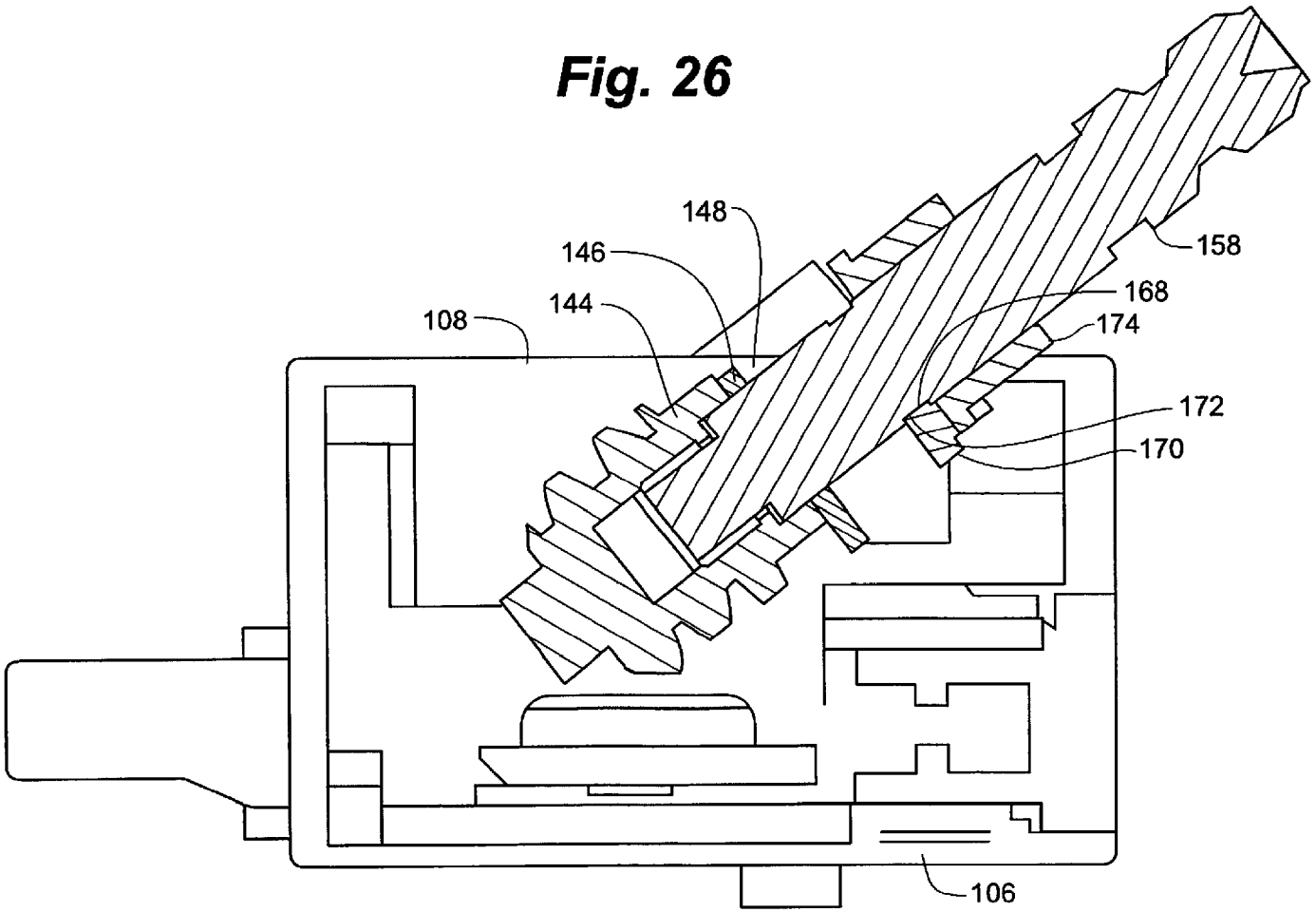
FIG. 26 is a cross-section taken through section 26-26 of FIG. 1.
Figure 27A:
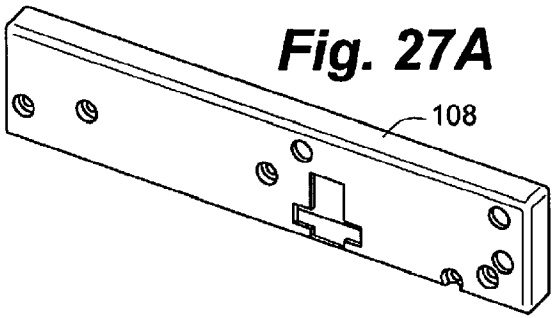
FIGS. 27A-27G are views of the upper housing of the operator of FIG. 1.
Figure 27B:
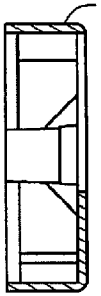
Figure 27C:
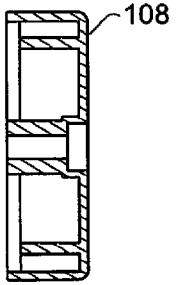
Figure 27D:
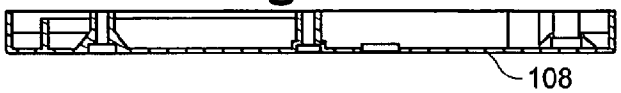
Figure 27E:
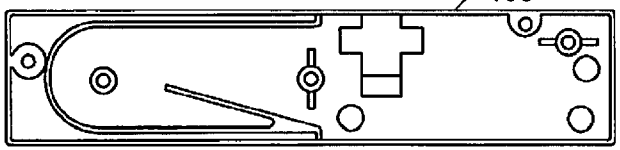
Figure 27F:
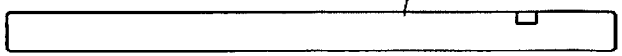
Figure 27G:
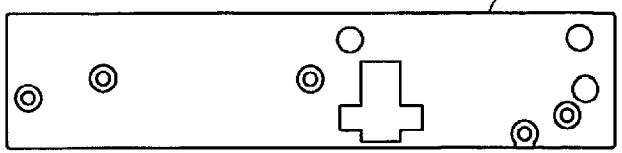
Figure 28E:
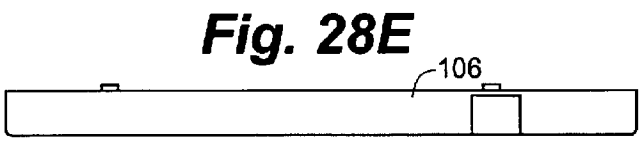
FIGS. 28A-28F are views of the lower housing of the operator of FIG. 1.
Figure 28F:
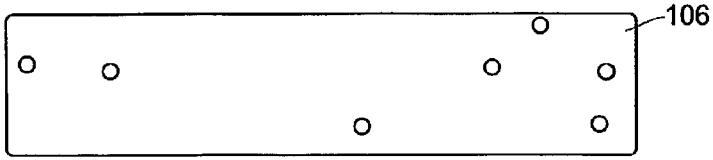
Figure 28A:
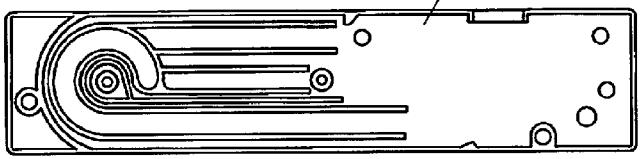
Figure 28B:
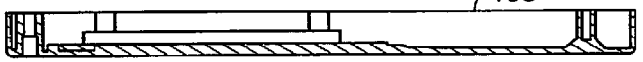
Figure 28D:
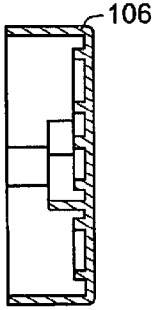
Figure 28C:
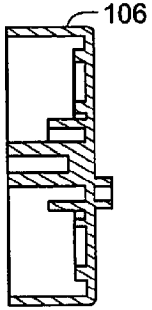
Figure 29A:
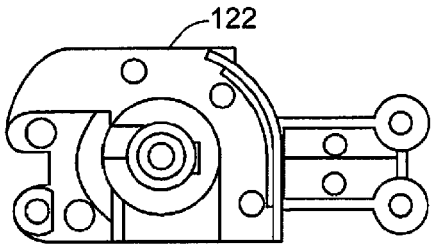
FIGS. 29A-29F are views of the body portion of the drive assembly of the operator of FIG. 1.
Figure 29E:
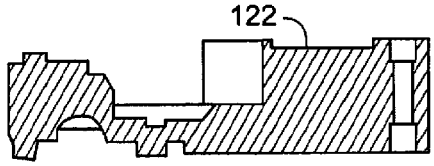
Figure 29F:
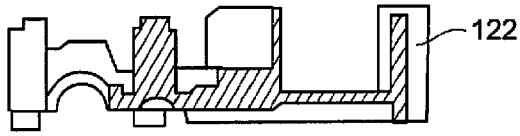
Figure 29B:
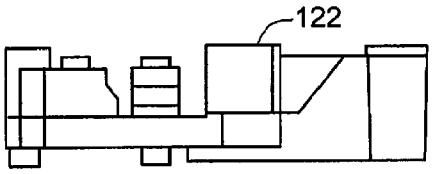
Figure 29D:
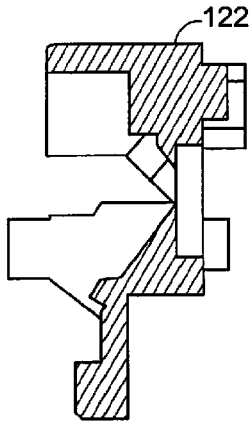
Figure 29C:
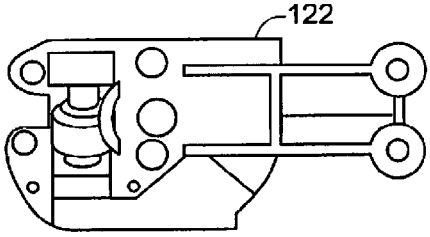

Drive shaft assembly 131 generally includes drive shaft 158 and drive shaft retainer assembly 160. Drive shaft 158 as depicted in FIGS. 17A-17D defines splines 162, 164, at each end. Barrel portion 166 defines groove 168 proximate the end with splines 162. Drive shaft retainer assembly 160 as depicted in FIGS. 13-15 generally includes lower housing 170, lock washer 172, and upper housing 174. Lower housing 170 defines aperture 176 therethrough, and upper housing 174 defines aperture 178. Upper housing 174 is received on lower housing 170 with apertures 176, 178, in registration. Lock washer 172 is received between lower housing 170 and upper housing 174 with tabs 180 facing downward toward lower housing 170. Drive shaft 158 extends through apertures 176, 178, such that splines 162 are engaged with internal splines 152 of worm 144 to rotationally lock drive shaft 158 with worm 144. Drive shaft assembly 131 is received on body 122 with apertures 176, 178, in registration with recess 150 of worm 144, and is secured in place with fasteners 182. Tabs 180 of lock washer 172 engage in groove 168 of drive shaft 158 to inhibit withdrawal of drive shaft 158 as further explained hereinbelow.

In use, operator 100 is secured to skylight frame 400 of skylight assembly 401. End 402 of chain 118 is coupled with skylight sash 404. Chain 118 is received in chain track 114 and extends through drive channel 186 of drive assembly 104 and outward through chain aperture 110. Sprocket 128 engages chain 118 such that chain 118 is extended and refracted with rotation of sprocket 128 as driven by rotation of worm 144 and pinion 124. The extension and retraction of chain 118 in turn shifts skylight sash 404 relative to frame 400 to open and close the skylight.

A notable feature of the depicted embodiments is the structure of drive shaft assembly 131. According to the invention, operator 100 may be mounted on a skylight without drive shaft 158 having been inserted. Drive shaft 158 is then advanced into drive shaft retainer assembly 160 until splines 162 are engaged with internal splines 152 of worm 144. Tabs 180 of lock washer 172 deflect downward, sliding on lower portion 190 of barrel 166 as drive shaft 158 is advanced until groove 168 is reached. Once groove 168 is reached, tabs 180 resiliently spring back so as to extend into groove 168. In this position, tabs 180 engage lower shoulder 192 of groove 168, inhibiting withdrawal of drive shaft 158. According to embodiments of the invention, this arrangement may inhibit withdrawal of drive shaft 158 even under forces of 100 pounds or more applied to pull drive shaft 158 from worm 144. Should it be desirable for field service, however, drive shaft 158 may be easily dissembled from operator 100 simply by removing fasteners 182 holding drive shaft assembly 131 to operator 100. By removing fasteners 182, the drive shaft retainer assembly 131 is removable from the operator 100 allowing the entire drive shaft 158 to be fed through the lock washer 172 in the non-engaging direction to separate the drive shaft 158 from drive shaft retainer assembly 131.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative embodiments.

What is claimed is:

1. A mountable operator for positioning a hinged movable sash of a window, comprising:

a drive assembly mountable to a frame of the window and having:

an extendable and retractable drive chain coupleable to a movable sash of the window such that extending and retracting the drive chain moves the movable sash relative to the frame of the window, and a sprocket for engaging the drive chain such that the rotation of the sprocket extends and retracts the drive chain;

a drive shaft insertable into the drive assembly after the drive assembly is mounted to the frame of the window to operably engage the sprocket, wherein the rotation of the drive shaft rotates the sprocket to extend and retract the drive chain; and a drive shaft retainer mountable to the drive assembly for receiving and selectively engaging the drive shaft inserted into the drive assembly, wherein the drive shaft retainer assembly defines an aperture for receiving the drive shaft after insertion of the drive shaft into the drive assembly such that the drive shaft retainer assembly rotatably engages the drive shaft to prevent the drive shaft from being withdrawn from the drive assembly; and the drive shaft retainer having at least one removable fastener that releasably mounts the drive shaft retainer assembly to the operator, wherein removing the removable fastener releases the drive shaft retainer assembly from the operator thereby releasing the drive shaft from the drive assembly such that the drive shaft can be withdrawn from the operator.

2. The mountable operator of claim 1, wherein the drive assembly further comprises:

a worm assembly comprising a proximate end for engaging the drive shaft and a distal end for engaging the sprocket, wherein the worm assembly translates the rotation of the drive shaft to the sprocket such that the rotation of the drive shaft rotates the sprocket to extend and retract the drive chain.

3. The mountable operator of claim 1, wherein the drive shaft retainer further comprises:

a lock washer positioned within the aperture of the drive shaft retainer assembly such that inserting the drive shaft into the drive assembly inserts a portion of the drive shaft through the lock washer, wherein the lock washer engages the drive shaft after insertion to prevent the drive shaft from being withdrawn from the drive assembly.

4. The mountable operator of claim 3, wherein the lock washer of the drive shaft retainer further comprises:

a plurality of tabs angled inwardly toward the drive assembly such that the plurality of tabs engages the drive shaft after the drive shaft is inserted into the drive assembly to prevent the drive shaft from being withdrawn from the drive assembly.

5. The mountable operator of claim 4, wherein the drive shaft defines a groove disposed on an exterior surface of the drive shaft positioned such that the plurality of tabs engage the groove alter the drive shaft is inserted into the drive assembly to prevent the drive shaft from being withdrawn from the drive assembly.

6. The mountable operator of claim 1, wherein the drive shaft is removable from the drive shaft retainer assembly after the drive shaft retainer assembly is separated from the drive assembly by drawing the drive shaft through the aperture of the drive shaft retainer assembly in the inserted direction.

* * * * *